US006155515A

United States Patent [19]

Dörfel et al.

[11] Patent Number: 6,155,515

[45] Date of Patent: Dec. 5, 2000

[54] CORE-INSERTION DEVICE FOR A WINDING MACHINE

[76] Inventors: G. Walter Dörfel, Beethovenstrasse 21, 7325 Boll; Jürgen Treutner, Elsterweg 17, 7302 Ostfildern 3, both of Germany

[21] Appl. No.: 09/180,303

[22] PCT Filed: Jun. 13, 1997

[86] PCT No.: PCT/EP97/03101

§ 371 Date: Nov. 5, 1998

§ 102(e) Date: Nov. 5, 1998

[87] PCT Pub. No.: WO97/47547

PCT Pub. Date: Dec. 18, 1997

[30] Foreign Application Priority Data

Jun. 13, 1996 [DE] Germany ..... 296 10 198 U
Aug. 5, 1996 [DE] Germany ..... 296 13 556 U

[51] Int. Cl.[7] ..... B65H 19/22

[52] U.S. Cl. ..... 242/533.2; 242/533.3

[58] Field of Search ..... 242/533.2, 533.3, 242/559.1; 414/910, 911

[56] References Cited

U.S. PATENT DOCUMENTS

| | | | |
|---|---|---|---|
| 4,723,724 | 2/1988 | Bradley | 242/56 |
| 4,726,533 | 2/1988 | Dropczynski | 242/56 |
| 4,856,725 | 8/1989 | Bradley | 242/56 |
| 4,909,454 | 3/1990 | Welp et al. | 242/65 |
| 4,962,897 | 10/1990 | Bradley | 242/56 |
| 5,000,395 | 3/1991 | Welp et al. | 242/65 |

FOREIGN PATENT DOCUMENTS

| | | |
|---|---|---|
| 0 199 286 A2 | 4/1986 | European Pat. Off. . |
| 0 244 059 A2 | 2/1987 | European Pat. Off. . |
| 0 258 533 | 5/1987 | European Pat. Off. . |
| 35 27 377 A1 | 7/1956 | Germany . |
| 27 51 829 A1 | 11/1977 | Germany . |
| 40 42 169 A1 | 12/1990 | Germany . |
| 1-267244 | 4/1988 | Japan . |

*Primary Examiner*—John Q. Nguyen

[57] ABSTRACT

A core-insertion device for a winding machine with at least one support or carrier drum for winding of web-like material to be wound, in particular paper or the like, with a device for feeding cores to a take-up position running approximately parallel to the at least one support or carrier drum(s), with a displacement device for holding, in a detachable way, and displacing the core(s) from the take-up position to a winding position located at the surface of the at least one support or carrier drum(s). The displacement device comprises, firstly, an elongated core carrier having a pivot joint arranged above its center of mass and core-holding device in its lower region, and secondly, an element which can be moved between the take-up position and the winding position for a free-swinging accommodation of the elongated core carrier at its pivot joint and for displacing the core carrier including at least one core from the take-up position to the winding position. It is possible merely to move the winding cores itself, but not its receiving recess, from the take-up position to the winding position on a predetermined path and at an unchanging angle with respect to the core axis, deeply into the winding bed, and then to release them there only when the winding cores have come into contact with the support drums.

14 Claims, 4 Drawing Sheets

CORE-INSERTION DEVICE FOR A WINDING MACHINE

Figure 1:
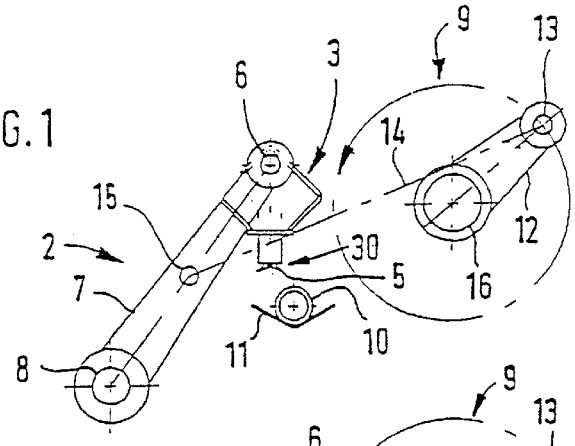

The invention pertains to a core-insertion device for a winding machine with at least one support or carrier drum for winding of web-like material to be wound, in particular paper or the like, with a means for feeding cores to a take-up position running approximately parallel to the at least one support or carrier drum(s), with a displacement means for holding, in a detachable way, and displacing the core(s) from the take-up position to a winding position located at the surface of the at least one support or carrier drum(s).

A core-insertion device of this kind for winding machines is known from DE-B1-2,930,474. In this known device, the take-up position is located on the side of the first support drum, viewing in web-running direction, opposite the winding bed formed between two support drums. A receiving recess is provided there for the winding cores for the next winding process. The winding cores are held in a clamped manner in the receiving recess by means of a pivotable guide rail. As the winding cores are inserted in the receiving recess, they are guided past a doublesided adhesive tape dispenser, which applies this tape to the location of the winding cores which faces downward in the winding bed between the two support drums when the winding cores are set in place. The transfer of the winding cores from the take-up position into the winding position takes place by means of guide-bars arranged on both sides of the first support drum, said guide-bars pivot the entire receiving recess, together with winding cores and clamping guide rail, across the top apex of the first support drum until the receiving recess with new winding cores is located upside down over the winding bed. Then the clamping guide rail is raised from the winding cores and the winding cores are released such that the latters drop on the support drums. This dropping is disadvantageous, because changes of the position of the adhesive tape can occur, such that the latter does not come into contact in the desired winding position, with the arriving web end for the next winding process. It is possible for the adhesive tape to adhere to the second support drum in web-running direction, such that this defect must be corrected before winding can begin. On the other hand, it is also not possible to lay down new winding cores in the winding bed such that they are released from their clamped position in the receiving recess only when they have a contact with the support drum. First, the space requirement of the receiving recess is too large and in addition, there is a risk of constraining force, occurring namely, if the transfer position in the winding bed is not approached with sufficient accuracy due to different diameters of the winding cores, for example.

Starting from this point, it is an object of the invention to create a generic core-insertion device, which can be used in order to bring winding cores, by means of restricted guidance, into contact with the support drums in the winding bed before the cores are detached from the displacement means.

In order to solve this problem, a core-insertion device of the same generic class is proposed in accordance with claim 1 for which the displacement means comprises, firstly, an elongated core carrier having a pivot joint arranged above its center of mass and with core-holding means in its lower region, and secondly, an element which can be moved between the take-up position and the winding position for a free-swinging accommodation of the elongated core carrier at its pivot joint and for displacing the core carrier including at least one core from the take-up position to the winding position.

Due to the invention, it is possible merely to move the winding cores itself, but not its receiving recess, from the take-up position to the winding position on a predetermined path and at an unchanging angle with respect to the core axis, deeply into the winding bed, and then to release them there only when the winding cores have come into contact with the support drums.

A core-insertion device in accordance with the invention is suitable for a wide variety of winding machines, but in particular for those winding machines in which the winding cores are first placed against the leader of a web of a new roll to be wound, that is, against the support drum wrapped by the winding web, whereby a second support drum subsequently is moved up to the first support drum.

The core carrier according to claim 2 can be designed in the form of a section carrier which extends parallel to the axis of the support or carrier drum and on which the core-holding means can be arranged at a fixed pitch in the simpler embodiment, hence, if each winding core of a winding core set for the entire width of the winding material has the same diameter.

Here, the size of the diameter does not matter. For larger diameters, in the starting phase the height of the core carrier is correspondingly adapted. However, a precondition is that the winding cores of a set have the same diameter.

Recently, however, it has been required that it should be possible to use winding cores of different diameters within one winding core set.

Admittedly, conventional core-holding means can manage differences in diameter of a few millimeters. Yet for newer requirements this is not enough. There is a need for arrangements in which, within one winding set, winding cores having a diameter, e.g., of 100 mm or 120 mm can be handled simultaneously with cores having a diameter of 180 mm.

Working with this amount of difference in the diameters of individual winding cores of a set was not possible for conventional core-insertion devices and the corresponding core-holding means.

The important embodiment in accordance with claim 4 solves the further-reaching problem of being able to clutch, in a take-up position, a winding core set of individual winding cores having diameters differing in the order of magnitude indicated, and being able to transfer the same to a winding position.

When the diameters of the winding cores differ, the core-holding means are brought to correspondingly different heights, in order always to be able to take hold of the winding cores in an optimal manner.

In the preferred embodiment, the variable pitch can be adjusted by attaching the core-holding means to a vertical slide bar (claim 5), where a movement of the core-holding means downward, until they rest on the winding cores, is achieved, in accordance with claim 6, by means of a piston/cylinder unit.

If, in accordance with claim 7, all the piston/cylinder units comprise a common inlet pipe for the fluid pressure medium, then, for an equal construction of the piston/cylinder units, this results in the same force being yieled overall, with which the piston/cylinder units can be displaced downward regardless of the height of the core-holding means.

In accordance with claim 8, the core-holding means can be pressed elastically into their upper, i.e., starting position, whereby the structural design may be carried out in the manner rendered in claims 9 and 10.

In the preferred embodiment of the invention, the core-holding means take hold of the winding cores pneumatically, i.e., by means of negative pressure.

In order to realize this idea, the preferred embodiment of the core-insertion device is embodied in accordance with claim 11, whereby the vacuum connection between the interior of the vacuum suction box and the interior of the core carrier can be realized in the manner disclosed in claim 12.

In order for the core-holding means, i.e., the vacuum suckers, to retain the height achieved when taking-up the winding cores during displacement to the winding position and in order to avoid problems while placing the winding cores on the support or carrier drum, it is recommended to hold or fix the position that has been achieved by means of a locking device in accordance with claim 13.

A solution for such a locking device with a relatively simply design consists of a clamping bar in accordance with claim 14, which extends across the core holder and acts upon all piston rods simultaneously such that it is only necessary to lift the clamping bar once in order to fix all the core-holding means.

Fixation can be realized in detail in the manner rendered in claim 15.

The element for picking up the core carrier, which can be displaced between a take-up position and a winding position, is formed advantageously by means of a pair of pivot arms (claim 16) engaging the ends of said core carrier, which arms can be moved by means of a crank mechanism in accordance with claim 17.

The embodiment in accordance with claim 18 guarantees an especially smooth movement during the take-up of the winding cores and during their supply to the winding position.

The components or process steps stated above, as well as those claimed or described in detail in the embodiments and used in accordance with the invention, are not subject to any particular exemptions with respect to size, design, material selection and technical conception, so that the selection criteria known in the particular field of application can be applied without limitation.

Figure 2:
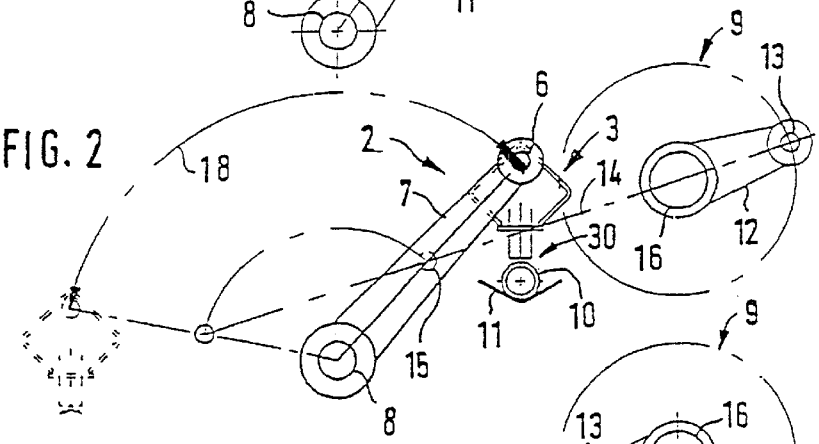

Additional details, properties and advantages of the subject matter of the invention follow from the following description of the attached drawings, in which two preferred embodiments of a core-insertion device in accordance with the invention are described, as examples. The figures show:

FIG. 1 a first embodiment of a core-insertion device in the waiting position, in end view with respect to the winding cores;

FIG. 2 the same core-insertion device in the take-up position as well as

Figure 3:
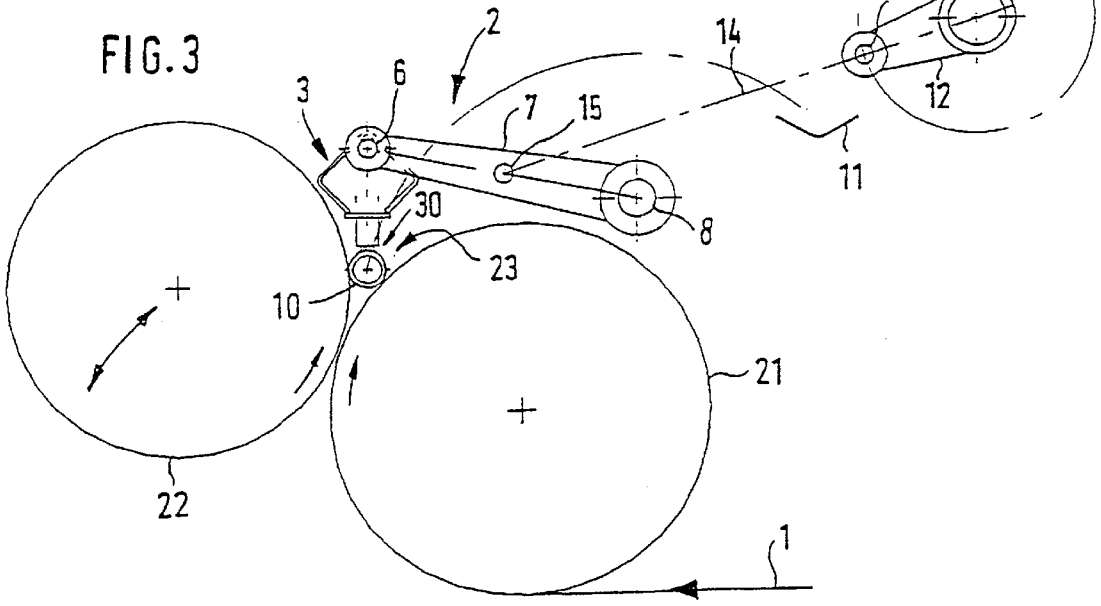
Figure 5:
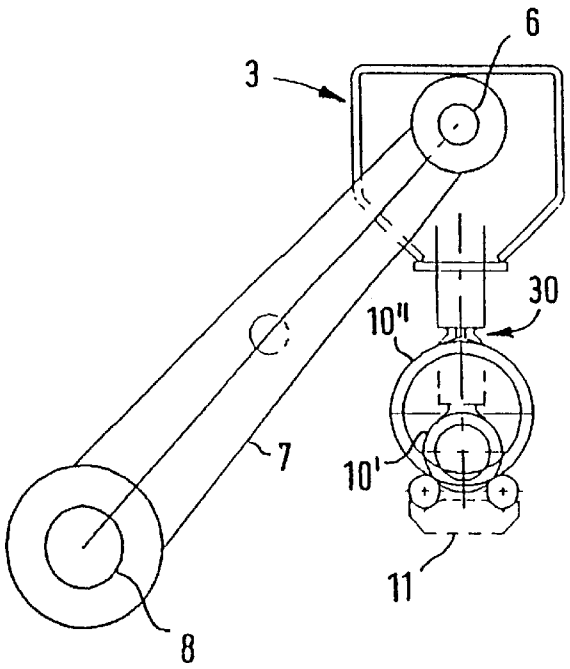
Figure 4:
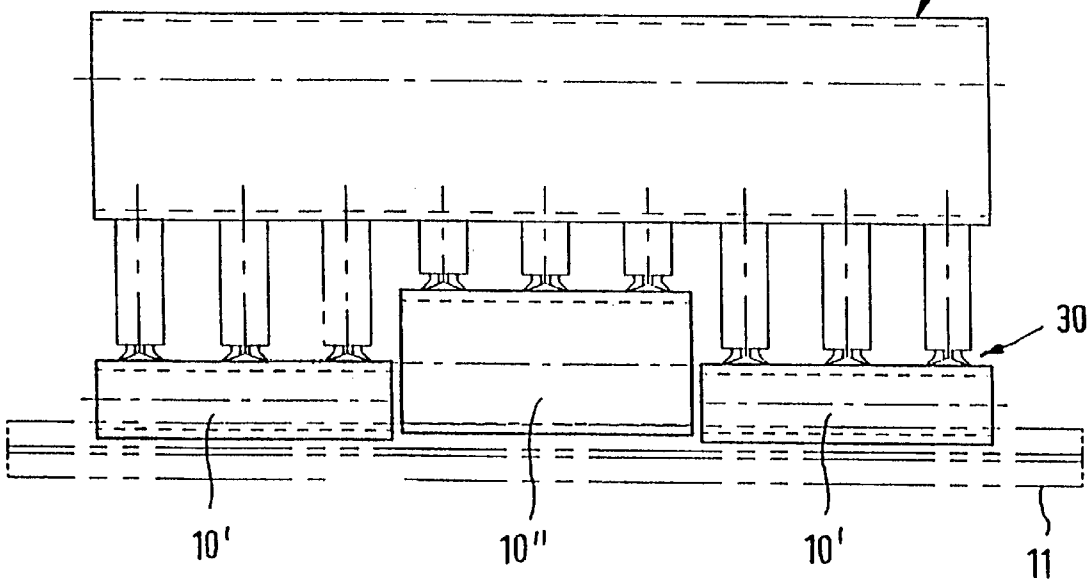
Figure 6:
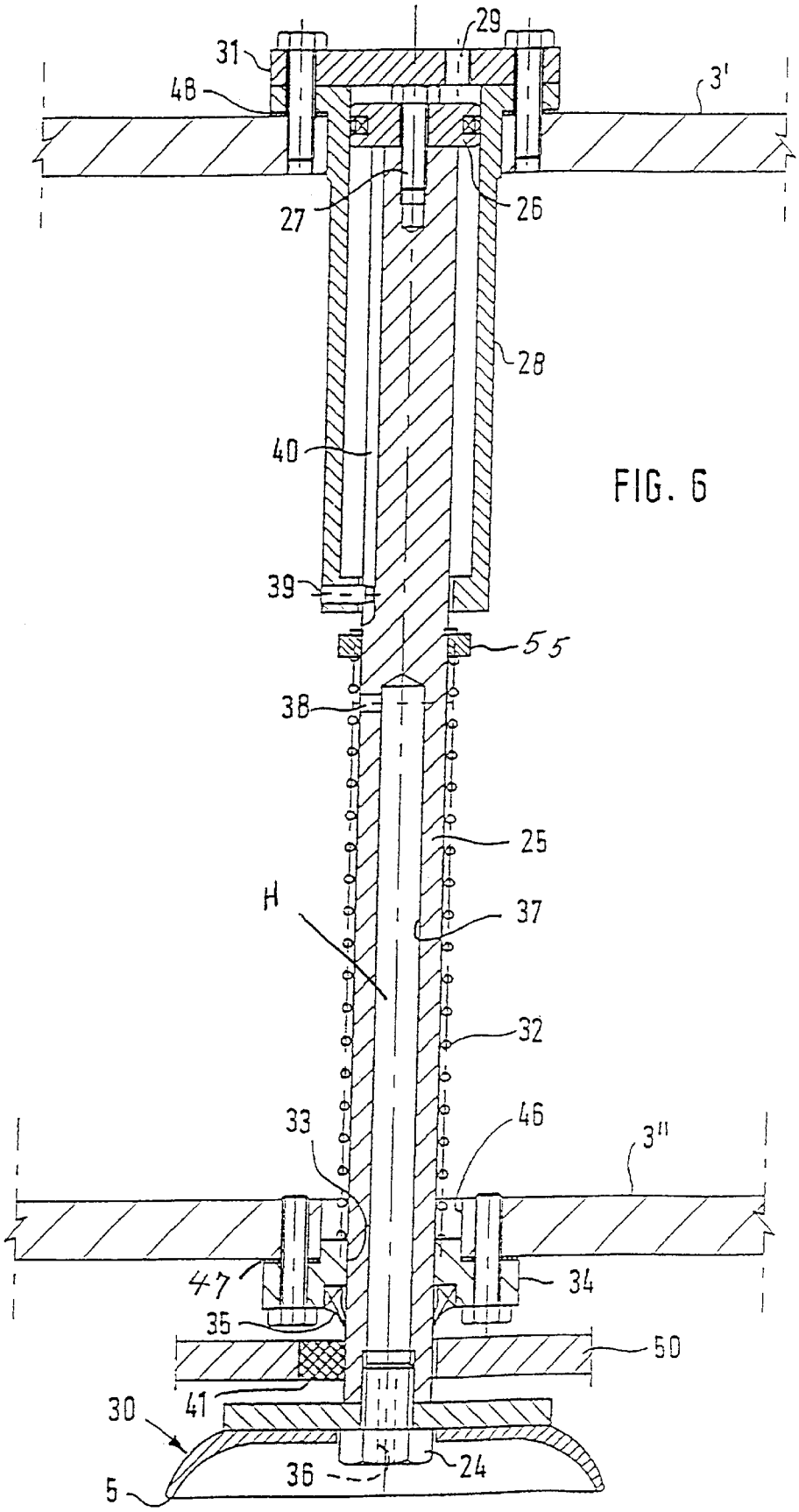
Figure 9:
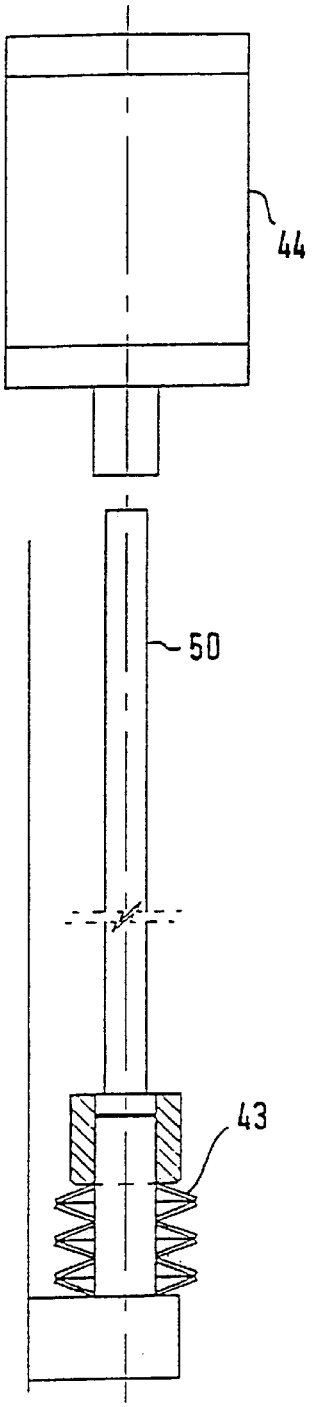
Figure 7:
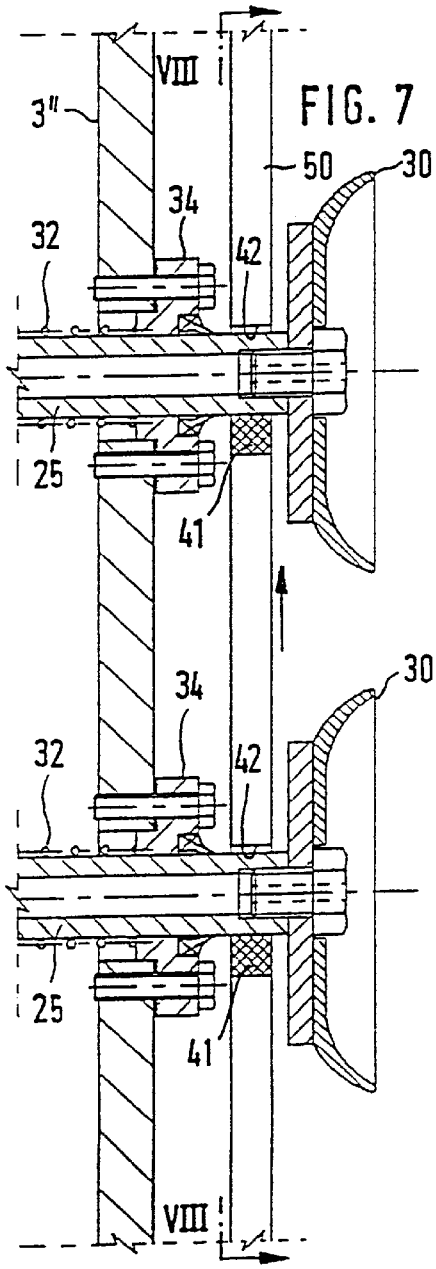
Figure 8:
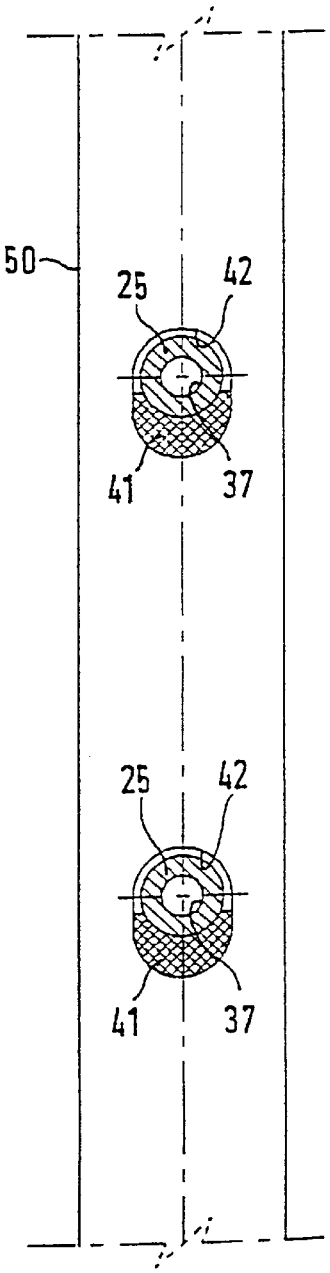

FIG. 3 the same core-insertion device in the winding-position;

FIG. 4 a schematized front view of the core carrier;

FIG. 5 a side view with pivot arms also rendered;

FIG. 6 a partial longitudinal section of the core carrier of a second embodiment of the core-insertion device;

FIG. 7 a view of the lower part of FIG. 6, with several vacuum suckers;

FIG. 8 a sectional view corresponding to line VIII—VIII in FIG. 7;

FIG. 9 a view of the mechanism of the clamping guide rail; and

Figure 10:
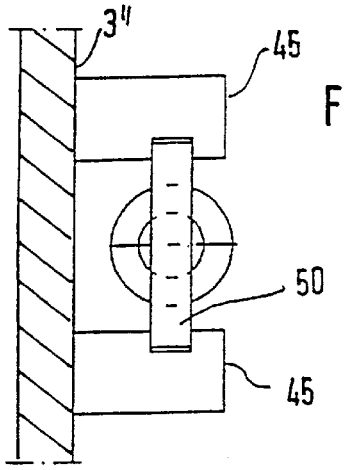

FIG. 10 a representation of a pillow block of the clamping guide rail.

As follows from FIG. 1, the winding cores 10 are located in their take-up position, into which they are inserted, pushed or otherwise transported during a winding process still in progress in an already known way, in a suitable receiver, e.g., a receiving recess 11, which extends approximately parallel to the at least one support or carrier drum of a winding machine. As is evident from FIG. 3, the embodiment illustrated in the figures and preferred to this extent pertains to a winding machine having a first support drum 21 wrapped by the at least one web 1 of paper or the like to be wound up. Together with the second support drum 22, viewed in machine direction, this first drum forms a winding bed 23 in the upper winding region in a conventionally known way.

In principle, the winding cores 10 can be supplied to a take-up position in the receiving recess 11 even by manually inserting the winding cores 10. In general, however, this supplying is carried out automatically, e.g., by a device which pushes the entire winding core set lengthwise into the receiving recess 11. The means required for this are not illustrated in FIGS. 1–3, since they are well known. During the supplying of the cores, a core displacement means 2 is located in a waiting position which allows an unhindered access to the receiving recess 11.

The core displacement means 2 has an elongated core carrier 3. In the embodiment illustrated and, to this extent, preferred, this core carrier is embodied as a closed hollow carrier, which is connected to a vacuum pump (not illustrated) and is equipped with core-holding means on its underside in the form of a multitude of vacuum suckers 30 lined up along the core carrier 3. These vacuum suckers are fluidly connected with the closed core carrier 3, which comprises an interior hollow space H and serves as a vacuum reservoir, and are equipped on their suction-side openings with sealing lips 5 which can make a tight seal with the surface of the winding cores 10 (see FIGS. 2 and 3).

The elongated core carrier 3 is equipped, e.g., at its two front ends above its gravitational center, with pivot joints 6 and is joined in a free-swinging manner to a pair of pivot arms 7. The pivot arms 7 can pivot about pivot bearings 8 by means of a pivot drive 9 by a defined angle, e.g., 120°, such that in the one extreme position the winding cores 10 can be picked up and in the other extreme position, the winding cores 10 can be transferred to the wind-up position. In this connection, care is taken that the core carriers 3 including the winding cores 10 are always swinging freely and, consequently, can hang downward. Therefore, it is also possible to travel a bit beyond the theoretical contact point on the first support drum 21 and the web 1 securely held thereupon, such that the core carrier 3 will take a slightly slanting position deviating from its vertical hanging position. At this point, the second support drum 22 in machine direction has not yet pivoted into its wind up position. The winding cores 10 are not located in their winding bed until the second support drum 22 has pivoted from below into its winding position (see FIG. 3) and the vacuum has been switched off. Afterward, the core carrier 3 moves back into the waiting position illustrated in FIG. 1. The winding cores 10 thus always rest with certainty on the new web 1 to be wound in their delivery position to the winding bed 23, which corresponds substantially with the wind up position.

The special pivot drive 9 shown in the embodiment illustrated in FIGS. 1–3 has proven to be especially advantageous. This involves a crank drive consisting of a rotary driven crank 12, whose radially outer bearing 13 is in an articulated connection by means of a push/pull rod 14 with the respective associated pivot arm 7. The coupling point 15 of the push/pull rod 14 at the pivot arm 7 as well as the length of the push/pull rod 14 between the coupling point 15 and the bearing 13 of the crank 12 are preferably selected such that the crank 12 will take on its top dead center point when the core carrier 3 is located in the take-up position illustrated in FIG. 2. The bottom dead center point of the crank 12 is preferably reached, as illustrated in FIG. 3, when the winding cores 10 with the core carrier 3 are located in the wind-up position. Thus causes, firstly, that the movement of the core carrier 3 into or out of the take-up position and wind up position takes place in a particularly gentle manner. On the other hand, this allows the direction of rotation of the crank 12 not to have to be reversed, but rather, a single direction of rotation can be retained. In addition, this also causes the two end points of the movement of the core carrier 3 to be maintained with sufficient geometric accuracy when the crank 12 comes to a stop a few degrees outside of the respective dead center position.

It goes without saying that the crank drive can also be replaced by other suitable actuator means, e.g., it is also conceivable to move the core carrier 3 in a straight line between the take-up position and the release position.

The particular advantage of a core-insertion device according to this invention, in conjunction with a lowerable second support drum 22 consists in the fact that the latter can be brought up to the winding position in a controlled manner, until coming into contact with a winding core 10 already resting on the first support drum 21 so that no damage is done if the winding core 10 should be moved somewhat beyond the first contact point on the first support drum 21 into a lower position.

In order to adapt the core-insertion device to different sized core diameters, the pivot bearing 8 of the pivot arm 7 and the crank shaft 16 of the crank 12 can jointly be displaced vertically. Thus, the aforementioned geometry of motion is fully retained, although the diameter of the winding cores can be randomly large, with the winding cores 10 of a winding core set nevertheless having equal diameters. Naturally, adjusting the height of the receiving recess 11 is also possible in principle.

With the core-insertion device in accordance with the invention very short roll change times can be obtained, e.g., in the order of 40 second range. Relatively wide tracks of glue, e.g. , of a 10 mm width, can be applied in a predetermined position on the winding cores 10, said tracks coming into effect at the proper location in the winding bed 23, e.g., initially facing precisely into the gap of the winding bed 23, hence, not touching the new web to be wound nor the second support drum 22.

FIGS. 4–10 illustrate an improved core-insertion device, for which the winding cores 10', 10" of a winding core set can also have outside diameters which differ widely from each other, e.g., in a range from 100 mm to 200 mm.

If winding cores 10', 10" having diameters with this type of difference are to be picked up by the core-holding means and subsequently laid down in the winding bed 23, this works only if the core-holding means, during pick-up from the receiving recess 11, can already take on different levels under the core carrier 3 which are adapted to the differences in diameter of the winding cores 10', 10", as illustrated in FIGS. 4 and 5. If the level of the core-holding means under the core carrier remains the same, the winding cores 10' having a smaller diameter cannot be picked up. An embodiment with a changeable level of the core-holding means is illustrated in FIG. 6–10 for core-holding means in the form of vacuum suckers 30.

As seen from FIGS. 1–3, the core carrier 3 has a somewhat hexagonal cross section. The upper wall 3' and lower wall 3" of the core carrier 3 can be seen in FIG. 6. The vacuum suckers 30 is fastened by means of a screw 24 to the bottom end of a piston rod 25, on the upper end of which is mounted a piston 26 by means of a screw 27. The piston 26 can move a cylinder 28, which extends from above through the upper wall 3' of the core carrier 3 into the interior cavity H of the same. A fluid pressure medium, with which it is possible to displace the piston 26, piston rod 25 and accordingly the vacuum sucker 3 downward, can be supplied to the interior of the cylinder 28 via an inlet 29 in the cylinder cover 31. Displacement is carried out against the force of a coil spring 32 which encloses the in FIG. 6 lower part of the piston rod 25; the bottom end of the coil spring is supported against a guide ring 34 which accommodates the bottom end of the piston rod 25 in a guide hole 33 in a sliding manner at a hole 46 in the bottom wall 3" of the core carrier 3, and the upper end of the coil spring is supported by an abutment 55 connected to the piston rod 25.

Since the interior of the core carrier 3 is evacuated, the guide ring 34 sits close on the lower wall 3" of the core carrier 3 by means of a seal 47 and, in addition, the guide ring 34 comprises a sealing lip 35 resting against the piston rod 25. The cylinder 28 is sealed by means of a seal 48 on the upper wall 3' for the same reason.

The screw 24 has a lengthwise through-hole 36 which opens into a longitudinal hole 37 of the piston rod 25, which is connected by a discharging transverse hole 38 in the center range of the length of the piston rod 25 to the interior of the core carrier 3.

The vacuum sucker 30 has an elongated horizontal projection. To avoid it's rotating, a transverse screw 39 which engages with a longitudinal groove 40 of the piston rod 25 is provided on the cylinder 28.

The inlets 29 of all the identically constructed cylinders 28 are connected to the same supply. When pressure is introduced by means of a fluid pressure medium, all vacuum suckers 30 are moved downward, hence, with equal force, until they come into contact with the associated winding cores 10', 10". The winding cores 10', 10" can be picked by the vacuum suckers 30 lying in their longitudinal extension at their periphery and can be raised. After the initianal contacting upon the winding cores 10', 10", the vacuum suckers 30 are at different levels, as seen in FIGS. 4 and 5. It is shown in FIGS. 7–10 how these levels can be fixed until the core carrier 3 has laid down the winding cores 10', 10" in the winding bed 23. A clamping bar 50 is provided extending lengthwise of the core carrier 3 and has long-holes 42 at the positions of the piston rods 25 of the individual vacuum suckers 30. The clamping bar 50 is arranged between the respective guide ring 34 and the vacuum suckers 30 and is guided in pillow blocks 45 distributed across the length of the clamping bar 50 and fastened to the lower wall 3" of the core carrier 3. The clamping bar 50 can be moved back and forth in a longitudinal direction in the pillow blocks 45.

A disk spring package 43 at one end of the clamping bar 50 acts against the same, as is evident in FIG. 9. Therefore, the clamping bar 50 is constantly pressed upward, corresponding to FIGS. 7–9.

The lower regions of the long-holes 42, hence, those regions facing the disk spring package 43, are filled out by means of clamping inserts 41, which, under the effect of the disk spring package 43 in accordance with FIG. 7, come to rest, in the direction of the arrow, on the outer periphery of the respective piston rod 25 and have a high coefficient of friction in comparison to the latter. Therefore, under the effect of the force of the disk spring package 43 all piston rods 25 and hence all vacuum suckers 30 are held at the level which they have taken on.

From the other end of the clamping bar 50, a release cylinder 44 operating in the longitudinal direction of the former can be brought into effect against the former; it presses the clamping bar 50 back against the force of the disk spring package 43, thereby releasing all the piston rods 25. Contacting of the vacuum suckers 30 on the different winding cores 10', 10" takes place in this state. Once this contacting has been carried out and the vacuum suckers 30 have taken on their different levels, the release cylinder 44 is retracted, so that the clamping bar 50 again comes under the effect of the disk spring package 43 and fixes the piston rods 25 in the different position. Hence, the arrangement is self-locking.

The basic idea of being able to adapt the levels of the core-holding means under the core carrier 3 to different diameters of the winding cores can also be carried out with advancement means other than piston/cylinder unit 26, 28, e.g., by means of a purely mechanical spring arrangement or electrically. Nor is the basic idea dependent on the core-holding means being vacuum suckers. The core-holding means can also pick-up the cores mechanically.

LIST OF REFERENCES

2 core displacement means
3 core carrier
3' upper wall
3" lower wall
5 sealing lips
6 pivot joints
7 pivot arms
8 pivot bearings
9 pivot drive
10 winding cores
11 receiving recess
12 crank
13 bearing
14 push/pull rod
15 coupling
16 crankshaft
21 first support drum
22 second support drum
23 winding bed
25 piston rod
26 piston
29 inlet
30 vacuum suckers
31 cylinder cover
32 coil spring
33 guide hole
34 guide ring
35 sealing lip
36 through-hole
37 longitudinal hole
40 longitudinal groove
42 long-holes
43 disk spring package
44 release cylinder
47, 48 sealing

What is claimed is:

1. A core-insertion device for winding machines having at least one support drum for winding of web-like material, the core insertion device being adapted to move at least one winding core between a take-up position extending approximately parallel to the at least one support drum and a winding position located at the surface of the at least one support drum, said core insertion device comprising a pivot arm pivotally mounted on the machine, an elongated core carrier pivotally attached above the carrier's center of mass to said pivoting arm at a pivot joint, with a pivot axis extending approximately parallel to the axis of the support drum for free-swinging accommodation of the elongated core carrier at the carrier's pivot joint, a core-holding means in said elongated core carrier's lower region for detachably holding the at least one winding core, said core-holding means being arranged on the underside of the core carrier at a changeable distance, and arranged on a vertical slide bar formed on the core carrier, and means for pivoting said pivot arm to move the core carrier including the at least one winding core from said take-up position to the winding position.

2. The core-insertion device of claim 1, characterized in that the core carrier is a section carrier which extends across the width of the web-like material to be wound.

3. The core-insertion device of claim 2, characterized in that said core insertion device includes a spaced apart pair of pivot arms, each of which is connected to opposite ends of said section carrier.

4. The core-insertion device of claim 1, characterized in that the core-holding means is arranged on the underside of the core carrier at a fixed distance.

5. The core-insertion device of claim 1, characterized in that the core carrier is a hollow section carrier that encloses a closed hollow space that is connected to a vacuum.

6. The core-insertion device of claim 1, characterized in that the core-holding means is structured to be moved vertically downward with respect to the core carrier by means of one piston/cylinder unit respectively which is actuated by means of a fluid pressure medium.

7. The core-insertion device of claim 6, characterized in that there are a plurality of core carriers, each of which includes a piston/cylinder unit, and all piston/cylinder units are connected to a common inlet pipe for the fluid pressure medium.

8. The core-insertion device of claim 7, characterized in that a locking device is provided for securing said core-holding means in the position reached after contacting upon the winding cores.

9. The core-insertion device of claim 8, characterized in that each piston/cylinder unit includes a piston rod, and the locking device is a clamping bar, for simultaneously working on all piston rods, which extends along the core holder, and which is spring-loaded in one longitudinal direction and is supplied with pressure in the other longitudinal direction by means of a second piston/cylinder unit.

10. The core-insertion device of claim 9, characterized in that the clamping bar has a plurality of long-holes, with each long-hole at the position of each piston rod and said clamping bar includes a clamping insert in each long-hole which comes into contact with each respective piston rod at the end opposite the direction of the spring loading.

11. The core-insertion device of claim 1, characterized in that the slide bar is formed by means of a piston/cylinder unit including a piston rod, at whose lower end the core-holding means is attached.

12. The core-insertion device of claim 11, characterized in that the core carrier is a hollow section carrier which encloses a closed hollow space which is connected to a vacuum, and the piston rod is bored out and the rod's bore hole is connected to the hollow space.

13. The core-insertion device of claim 11, characterized in that the piston rod is enclosed by a coil spring which is supported on one side on the core carrier and, on the other side, on an abutment on the piston rod.

14. A core-insertion device for winding machines having at least one support drum for winding of web-like material, the core insertion device being adapted to move at least one winding core between a take-up position extending approximately parallel to the at least one support drum and a winding position located at the surface of the at least one support drum, said core insertion device comprising a pivot arm pivotally mounted on the machine, an elongated core carrier pivotally attached above the core carrier's center of mass to said pivoting arm at a pivot joint, with a pivot axis extending approximately parallel to the axis of the support drum for free-swinging accommodation of the elongated core carrier at the core carrier's pivot joint, a core-holding means in said elongated core carrier's lower region for detachably holding the at least one winding core, and means for pivoting said pivot arm to move the core carrier including the at least one winding core from said take-up position to the winding position, said means for pivoting said pivot arm comprising a crank drive, the crank drive having a dead center position, and the crank drive being arranged so that a take-up of the winding core from the take-up position and the supply of the winding core to the winding position are carried out in each case at approximately the dead center of the crank drive.

* * * * *